US009040217B2

(12) United States Patent
Takatsuka et al.

(10) Patent No.: US 9,040,217 B2
(45) Date of Patent: May 26, 2015

(54) CARRIER, TWO-COMPONENT DEVELOPER USING THE SAME, AND IMAGE-FORMING APPARATUS USING SAID DEVELOPER

(75) Inventors: Kazuki Takatsuka, Yamatokoriyama (JP); Tatsuo Imafuku, Nara (JP); Takahiro Bito, Nara (JP); Takeshi Satoh, Yamatokoriyama (JP); Masaki Ueji, Nara (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 1587 days.

(21) Appl. No.: 12/393,313

(22) Filed: Feb. 26, 2009

(65) Prior Publication Data

US 2009/0226218 A1 Sep. 10, 2009

(30) Foreign Application Priority Data

Feb. 28, 2008 (JP) ..... 2008-048078

(51) Int. Cl.
*G03G 9/10* (2006.01)
*G03G 15/08* (2006.01)
*G03G 9/113* (2006.01)

(52) U.S. Cl.
CPC ..... *G03G 9/1136* (2013.01); *G03G 9/1137* (2013.01); *G03G 9/1138* (2013.01); *G03G 9/1139* (2013.01)

(58) Field of Classification Search
CPC . G03G 9/1136; G03G 9/1137; G03G 9/1138; G03G 9/1139
USPC ..... 430/111.1, 111.3, 111.31, 111.32, 430/111.35, 108.3
See application file for complete search history.

(56) References Cited

U.S. PATENT DOCUMENTS

| | | | | |
|---|---|---|---|---|
| 5,407,774 | A | 4/1995 | Matsushima et al. | |
| 5,518,852 | A * | 5/1996 | Sukata et al. | 430/108.24 |
| 5,942,364 | A * | 8/1999 | Anno et al. | 430/111.35 |
| 5,952,145 | A | 9/1999 | Yamanaka et al. | |
| 6,391,511 | B1 | 5/2002 | Okamoto et al. | |
| 6,828,075 | B2 | 12/2004 | Suzuki et al. | |
| 7,070,897 | B2 | 7/2006 | Imafuku et al. | |
| 2003/0082471 | A1 | 5/2003 | Imafuku et al. | |
| 2006/0068314 | A1 * | 3/2006 | Kawata | 430/110.4 |
| 2007/0287089 | A1 * | 12/2007 | Kimura et al. | 430/108.2 |
| 2008/0014514 | A1 * | 1/2008 | Kamoto | 430/45.56 |
| 2009/0226218 | A1 | 9/2009 | Takatsuka et al. | |
| 2009/0311620 | A1 | 12/2009 | Hirata et al. | |

FOREIGN PATENT DOCUMENTS

| | | |
|---|---|---|
| CN | 1416026 A | 10/2002 |
| JP | 01-134467 | 5/1989 |
| JP | 1-54694 | 11/1989 |
| JP | 6-35229 | 2/1994 |

(Continued)

OTHER PUBLICATIONS

Office Action dated Jun. 7, 2011, issued in connection with U.S. Appl. No. 12/482,663.

*Primary Examiner* — Stewart Fraser
(74) *Attorney, Agent, or Firm* — Nixon & Vanderhye P.C.

(57) ABSTRACT

The present invention provides a carrier for a two-component electrophotographic developer, comprising a core particle and a thermoset silicone resin layer coated thereon, wherein said layer comprises a charge control agent and is formed by heat-treatment at a temperature below the melting point of said charge control agent.

8 Claims, 3 Drawing Sheets

(56) References Cited

FOREIGN PATENT DOCUMENTS

| | | |
|---|---|---|
| JP | 07-301958 | 11/1995 |
| JP | 8-137138 | 5/1996 |
| JP | 09-006054 | 1/1997 |
| JP | 11-72969 | 3/1999 |

* cited by examiner

CARRIER, TWO-COMPONENT DEVELOPER USING THE SAME, AND IMAGE-FORMING APPARATUS USING SAID DEVELOPER

CROSS-REFERENCE TO RELATED APPLICATION

This application is related to Japanese Patent Application No. 2008-48078 filed on Feb. 28, 2008, whose priority is claimed under 35 USC §119, the disclosure of which is incorporated herein in its entirety by reference for any and all purposes.

BACKGROUND OF THE INVENTION

1. Field of the Invention

The present invention relates to a carrier, a two-component developer using the same, and an image-forming apparatus using said developer. The carrier according to the present invention can be used as a component in a two-component developer preferably suitable for electrophotographic image-forming apparatuses, such as copiers, printers, facsimile machines and the like.

2. Description of the Related Art

In an electrophotographic image-forming apparatus, generally, an image is formed by the steps of charging, light-exposure, development, transfer, cleaning, discharge and fixing. Specifically, for example, the surface of a rotating photoconductor is uniformly charged by a charger, and then exposed to laser light emitted from a light exposure device according to the image information, thereby forming an electrostatic latent image thereon. The latent mage is developed by a developing device into a toner image, which is then transferred by a transfer device onto a recording material, where the toner image is heated to be fixed by a fixing device. The residual toner on the surface of the photoconductor is removed off and collected in a collection chamber by a cleaning device. The cleaned surface of the photoconductor is discharged by a discharger so as to be ready for the next round of the image-forming process.

As a developer for a latent image on a photoconductor, generally a single-component developer comprising toner alone, or a two-component developer comprising toner and carrier are used.

Since single-component developers do not need to be mixed before use, they have an advantage that developing devices used therewith have a simple structure with no mixer or the like. However, they have a problem of being difficult to charge toner stably, etc.

On the other hand, since two-component developers need to be stirred before use in order to homogeneously mix toner and carrier, they have a problem that developing devices used therewith have a complicated structure with a mixer or the like. However, the two-component developers have good charge stability and good applicability to high-speed machines, and therefore are commonly used in high-speed image-forming apparatuses and multicolor image-forming apparatuses.

As a carrier used in a two-component developer, a magnetic particle of ferrite or the like having a particle size of 20 to 100 μm is generally used. The magnetic particle has, on its surface, a coating layer of acrylic resin, silicone resin or the like, so as to reduce the moisture-dependent changes in the characteristics and fusion of toner to the surface. In particular, a carrier composed of a magnetic particle (core particle) coated with a thermoset silicone resin has advantages that such a carrier has excellent durability and a toner component or the like is difficult to adhere on the carriers surface (see, for example, Japanese Patent Laid-Open Publication No. Hei 9 (1997)-6054).

However, when used in a two-component developer, a carrier coated with a thermoset silicone resin markedly increases in the amount of electrostatic charge after approximately 1,000 to 5,000 rounds of the developing process. As the result, the image density decreases. Even if a charge control agent of the same polarity as the toner combined with the carrier is added to the silicone resin in order to suppress the increase in the amount of charge, it is not possible to completely prevent the decrease in image density, since the amount of charge varies among the production lots.

SUMMARY OF THE INVENTION

As the result of diligent efforts to solve the problem described above, the inventors have discovered that the variation in charge of such a carrier at the early phase of use is associated with the denaturation of the charge control agent by heat-treatment for curing the silicone resin coated on the carrier surface. Although the mechanism has not yet been elucidated, it is suspected that by heating at the time of curing the silicone resin, the charge control agent may be melted to aggregate together and/or bleed to the carrier surface and/or the like, resulting in change in the distribution of the charge control agent. It is also suspected that the denaturation may result from the charge control agent being heat-decomposed and/or being amorphousized after cooling.

Accordingly, the present invention provides a carrier for a two-component electrophotographic developer, comprising a core particle and a thermoset silicone resin layer coated thereon, wherein said layer comprises a charge control agent and is formed by heat-treatment at a temperature below the melting point of said charge control agent.

The present invention also provides a two-component developer comprising toner and said carrier.

The present invention further provides an electrophotographic image-forming apparatus which utilizes said two-component developer as a developer.

BRIEF DESCRIPTION OF THE DRAWINGS

The present invention will become more fully understood from the detailed description provided herein below and the accompanying drawings which are given by way of illustration only, and wherein.

DETAILED DESCRIPTION OF THE INVENTION

Figure 1:
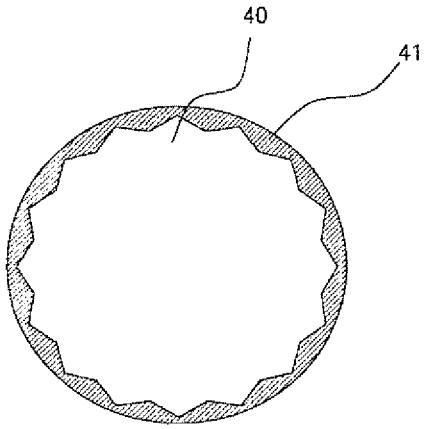
FIG. 1 is a conceptual illustration of an embodiment of a carrier according to the invention.

Before the invention is described in detail, it must be noted that, as used herein and in the appended claims, the singular forms "a", "an" and "the" include plural referents unless the context clearly dictates otherwise.

The carrier according to the present invention comprises a core particle and a thermoset silicone resin layer coated thereon, wherein said thermoset silicone resin layer comprises a charge control agent and wherein said layer is formed by heat-treatment at a temperature below the melting point of said charge control agent.

In the carrier according to the present invention, since the silicone resin layer is heat-treated at a temperature below the melting point of the charge control agent comprised therein, the denaturation of the charge control agent is inhibited, and therefore the chargeable amount of the carrier is not largely varied. Also, such a silicone resin layer is excellent in strength.

According to the present invention, it is also possible to reduce an increase in the toner charge in the early phase of use. As the result, the image quality is stable for a long period of time.

In one embodiment of the carrier according to the invention, said charge control agent is an organic silicon complex compound represented by the general formula (1):

(1)

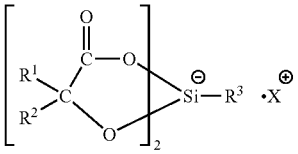

wherein $R^1$, $R^2$ and $R^3$ each independently represent hydrogen atom, or a substituted or unsubstituted, alkyl, cycloalkyl, aryl or aralkyl group; and $X^+$ represents an organic or inorganic cation, or a calixarene compound represented by the general formula (2):

(2)

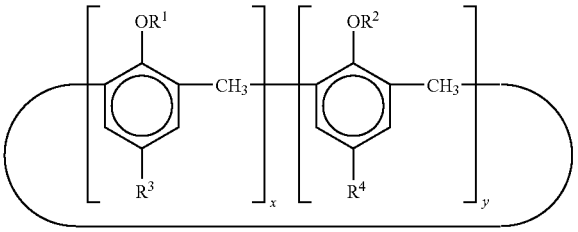

wherein x+y=n; x and y are each an integer equal to or greater than 1; n is an integer from 4 to 8; the x and y repeating units can occur in any order; $R^1$, $R^2$, $R^3$ and $R^4$ each independently represent hydrogen atom, an optionally branched alkyl group having 1 to 12 carbon atoms, an optionally substituted aralkyl group having 7 to 12 carbon atoms, or an optionally substituted phenyl group. According to this embodiment, it is possible to reduce the increase in the amount of toner charge. The carrier can supply a stable amount of charge to the toner.

In another embodiment of the carrier according to the invention, said thermoset silicone resin layer is formed by coating said core particle with a thermosetting silicone resin not containing said charge control agent, and then with a thermosetting silicone resin containing said charge control agent, and subsequently by said heat treatment at a temperature below the melting point of said charge control agent. In other words, in this embodiment, said thermoset silicone resin layer consists of an outer region (or outer layer), which comprises said charge control agent, and an inner region (or inner layer), which does not comprise said charge control agent.

According to this embodiment, it is possible to reduce the increase in the amount of toner charge in the early phase of use (or immediately after the start of use) due to the presence of a predetermined amount of the charge control agent in the surface region (or outer region) of the resin layer. On the other hand, when the carrier resistance decreases as the result of abrasion of the resin layer so as to partially expose the core particle (after printing about 5,000 sheets, for example), it is possible to prevent the decrease in the amount of toner charge, since the residual inner region does not contain the charge control agent.

In a specific embodiment, said thermosetting silicone resin containing the charge control agent further comprises a conductive agent. In other word, said outer region further comprises the conductive agent.

According to this embodiment, it is possible to prevent the decrease in the image density immediately after the start of use (in the early phase of use).

In another embodiment, said thermoset silicone resin layer is a dimethyl silicone resin layer.

This embodiment makes filming of the toner binder resin on the carrier surface harder. As the result, it is possible to provide a stable chargeability over a long period of time.

In another embodiment, the core particle comprises ferrite.

According to this embodiment, it is possible that a carrier has high saturation magnetization and low density, making the carrier harder to adhere onto the photoconductor. As the result, a soft magnetic brush of the developer can be formed so as to obtain an image having high dot reproducibility.

Hereinafter, the present invention will be described in more detail.

Carrier

The carrier according to the present invention comprises a core particle and a thermoset silicone resin layer coated thereon, wherein said thermoset silicone resin layer comprises a charge control agent and wherein said thermoset silicone resin layer is formed by heat-treatment at a temperature below the melting point of said charge control agent.

FIG. 1 is a conceptual diagram illustrating the coating of an embodiment of the carrier according to the invention. The rough surface of a core particle 40 is coated with a thermoset silicone resin layer 41 comprising a charge control agent.

Figure 2:
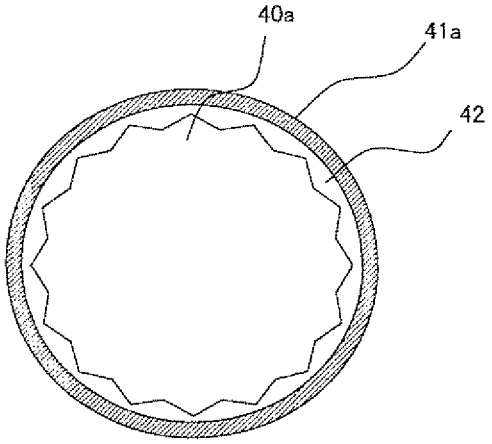
FIG. 2 is a conceptual illustration of another embodiment of a carrier according to the invention.

FIG. 2 is a conceptual diagram illustrating the coating of another embodiment of the carrier according to the invention. The rough surface of a core particle 40*a* is coated with a thermoset silicone rein layer 42 not containing a charge control agent, which layer is in turn coated with a thermoset silicone resin layer 41*a* containing a charge control agent. According to this embodiment wherein the resin layer coated on the core particle has a two-layered (two-region) structure, it is possible to reduce the increase in the amount of toner charge immediately after the start of use (or in the early phase of use), and to prevent an extreme decrease in the amount of toner charge when the carrier resistance decreases as the result of abrasion of the resin layer to partially or entirely expose the core particle.

As the charge control agent in the thermoset silicone resin layer, any of the known negative charge control agents can be used.

Although an organic silicon complex compound and calixarene compound having a melting point of from 100° C. to 220° C., in particular, are excellent in dispersibility in a silicone resin and charge control effect, they are easy to denature by heating. Therefore, when used in the thermosetting silicon resin, they are instable in their chargeability after curing the resin. As the result, the obtained carrier is instable in the charge amount when frictionally charged.

Thus, in the present invention, the heat-treatment for curing the silicone resin layer is at a temperature below the melting point of the charge control agent.

Thus obtained carrier is stable in the chargeability, and can reduce an increase in the charge amount of the toner used together with the carrier, in the early phase of use. Also, the carrier is hard to adhere onto the photoconductor and can prevent a decrease in the amount of toner charge, over a long period of time.

It is preferable that the charge control agent is an organic silicon complex compound represented by the general formula (1).

(1)

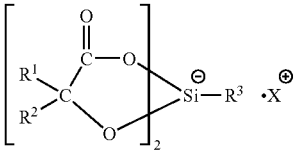

wherein $R^1$, $R^2$ and $R^3$ each independently represent hydrogen atom, or a substituted or unsubstituted, alkyl, cycloalkyl, aryl or aralkyl group; and $X^+$ represents an organic or inorganic cation, or a calixarene compound represented by the general formula (2):

(2)

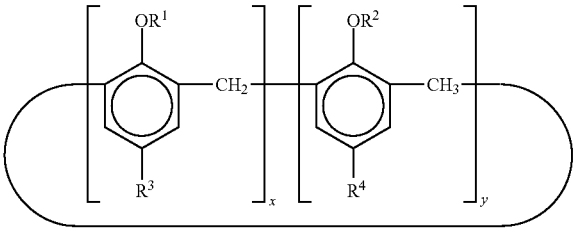

wherein x+y=n; x and y are each an integer equal to or greater than 1; n is an integer from 4 to 8; the x and y repeating units can occur in any order; $R^1$, $R^2$, $R^3$ and $R^4$ each independently represent hydrogen atom, an optionally branched alkyl group having 1 to 12 carbon atoms, an optionally substituted aralkyl group having 7 to 12 carbon atoms, or an optionally substituted phenyl group, since they are hard to increase in their charge amount and thus have stable chargeability. In addition, since these compounds are colorless, it is possible to prevent a color image from being clouded even if a color toner is contaminated with any of the compounds.

The organic silicon complex compounds represented by the general formula (1) include, but not limited to, the following compounds:

Compound 1

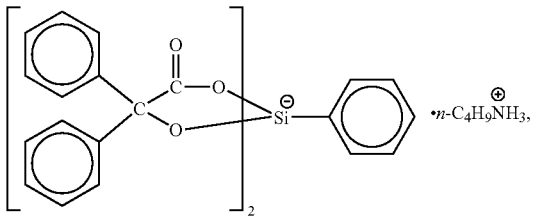

Compound 2

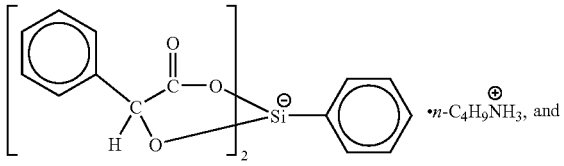

Compound 3

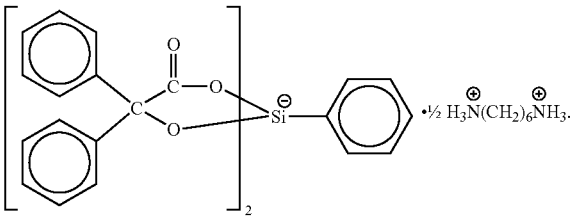

The organic silicon complex compounds represented by the general formula (1) can be synthesized according to C. L. Frye, J. Am. Chem. Soc., 92, 1205 (1970).

The calixarene compounds represented by the general formula (2) include, but not limited to, the following compounds:

Compound 4

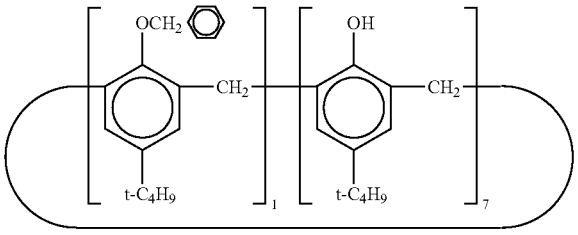

, and

-continued

Compound 5

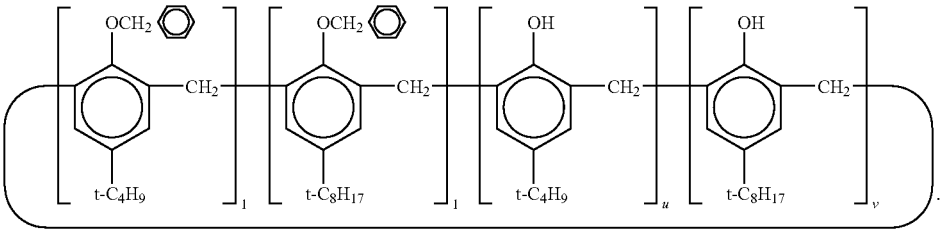

The calixarene compounds represented by the general formula (2) can be synthesized according to Japanese Patent Laid-Open Publication No. Hei 8 (1996)-137138.

It is preferred that the charge control agent(s) is present at an amount of from 5% to 20% by weight based on the weight of the silicone resin in the silicone resin layer. The presence of the charge control agent in this range in the silicon resin layer allows for efficiently reducing a remarkable increase or decrease in the charge amount of the toner used together with the carrier.

The volume average particle size of the carriers is preferably from 20 to 100 μm, more preferably from 30 to 60 μm, although it is not limited. If the volume average particle size is too small, it is likely that such carriers easily travel from the developing roller to the photoconductor drum during the developing step, and thus that white spots appear in the toner image. If the volume average particle size is too large, it is likely that the dot reproducibility becomes worse and therefore the formed image becomes rough. In the context of the volume average particle size of the carriers, the particle size is intended to mean the sum of the diameter of the core particle and the thickness of the silicone resin layer (if the silicone resin layer is a two-layered structure, including the inner and outer layers) coated on the core particle. The definition of volume average particle size is indicated below.

The lower the saturation magnetization of the carriers is, the softer the magnetic brush is and therefore the more faithful to the latent image the toner image is formed. On the other hand, if the saturation magnetization is too low, it is likely that the carriers adhere onto the photoconductor drum, and therefore white spots appear in the toner image. If the saturation magnetization is too high, it is likely that the magnetic brush is too hard to form the toner image faithful to the latent image. Accordingly, the saturation magnetization of the carriers is preferably in the range of from 30 to 100 emu/g, and more preferably from 50 to 80 emu/g. The definition of saturation magnetization of the carriers is indicated below.

Resin-coated carriers are likely to adhere to the photoconductor if the carrier's volume resistivity is low, and are likely to cause an increase of the toner charge if the volume resistivity is high. Accordingly, the volume resistivity of the carriers is preferably in the range of from $1\times10^8$ to $5\times10^{12}$ Ω·cm, and more preferably from $1\times10^9$ to $5\times10^{12}$ Ω·cm. The definition of volume resistivity is indicated below.

Core Particle

As a core particle, any of the known magnetic particles can be used. It is preferred to use a magnetic particle containing ferrite (ferrite particle). Since ferrite particles have high saturation magnetization, they can be used to make low density carriers, which are hard to adhere onto the photoconductor and can form a soft magnetic brush. As the result, it is possible to obtain an image having high dot reproducibility.

For such ferrite particles, any known ferrites can be used, such as zinc ferrite, nickel ferrite, copper ferrite, nickel-zinc ferrite, manganese-magnesium ferrite, copper-magnesium ferrite, manganese-zinc ferrite, manganese-copper-zinc ferrite and the like.

The volume average particle size of the core particle preferably ranges from 20 to 80 μm, and more preferably from 30 to 60 μm. The definition of volume average particle size of the core particles is indicated below.

It is preferable that the core particles have a volume resistivity of $1\times10^6$ to $1\times10^{11}$ Ω·cm when measured according to the bridge method. Ferrite particles having such a range of volume resistivity are commonly used for core particles since the cost is low. If the volume resistivity is too low, the electrical insulation is insufficient so that toner fogging occurs in the formed image. If the volume resistivity is too high, it is likely that the counter-charge remaining on the carriers causes the edge effect in a solid image and a decrease of the image density. More preferably, the volume resistivity is in the range of $1\times10^8$ to $5\times10^{10}$ Ω·cm. The definition of volume resistivity is indicated below.

The ferrite particles can be prepared by any of the known methods, for example, as follows: ferrite materials such as $Fe_2O_3$ or $Mg(OH)_2$ are mixed and calcinated in a furnace. After cooling, the calcination product is milled in a vibrating mill so as to obtain particles having a diameter of about 1 μm. The particles together with a dispersant are added in a water to prepare a slurry. The slurry is milled in a wet type ball mill and the resultant suspension is dry-granulated with a spray-drier.

Thermoset Silicone Resin Layer

Thermosetting silicone resins formed into the thermoset silicone resin layer are such silicone resins that are curable by bridging two Si atoms due to heat dehydration from the two hydroxyls on the Si atoms, as shown below.

Heat Dehydration Reaction

Heat Dehydration Reaction

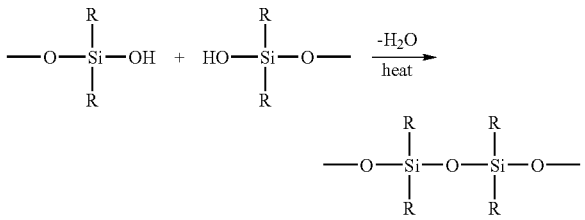

wherein R's, equal to or different from one another, represent monovalent organic groups.

For curing, thermosetting silicone resins are required to be heated at a temperature of around 150 to 250° C. Alternatively, in order to lower the curing temperature below the melting point of the charge control agent to be contained in the thermoset silicone resin layer, it is possible to use a catalyst. The curing catalysts include octylic acid, tetramethylammonium acetate, tetrabutyl titanate, tetraisopropyl titanate, dibutyltin diacetate, dibutyltin dioctoate, dibutyltin laurate, γ-aminopropyl trimethoxysilane, γ-aminopropyl triethoxysilane, N-(β-aminoethyl)aminopropyl trimethoxysilane, γ-aminopropyl methyldiethoxysilane, N-(β-aminoethyl)aminopropyl methyldimethoxysilane, and the like.

Among thermosetting silicone resins, dimethyl silicone is preferable where all of the monovalent organic groups represented by R are methyl groups. Since cross-linked dimethyl silicone has a dense structure, it is possible to obtain such a carrier having a surface, onto which a toner component (binder resin) is hard to adhere, and having a good water-repellence and moisture-resistance if the coating layer is made of dimethyl silicone. There is a tendency that the coating layer of cross-linked resin is brittle if the cross-linked structure is too dense. Accordingly, it is important to select the molecular weight of the silicone resin appropriately.

It is preferable to use such a silicone resin with a ratio by weight of silicon to carbon (Si/C) of from 0.3 to 2.2. If the ratio Si/C is less than 0.3, it is likely that the hardness of the coating resin layer is low and therefore the life of the carriers is short. If the Si/C ratio is greater than 2.2, it is likely that the ability of the carrier to impart charge to the toner is susceptible to changes in temperature, and that the coating resin layer is brittle.

Such commercially available thermosetting silicone resins that can be used in the invention include, for example, silicone varnish, such as TSR 115, TSR 114, TSR 102, TSR 103, YR 3061, TSR 110, TSR 116, TSR 117, TSR 108, TSR 109, TSR 180, TSR 181, TSR 187, TSR 144, and TSR 165 (from Toshiba Corporation, Japan); KR 271, KR 272, KR 275, KR 280, KR 282, KR 267, KR 269, KR 211, KR 212 (from Shin-Etsu Chemical Co., Ltd., Japan).

A thermosetting silicone resin may be used alone, or two or more thermosetting silicone resins may be used in combination.

The thermoset silicone resin layer may contain a conductive agent in order to reduce the electrical resistance of the layer. The conductive agent is preferably contained in the region containing the charge control agent of the layer, for example, in the outer region (or the outer layer, if the layer has a two-layered structure).

The conductive agents that can be used in the present invention are not specifically limited, so long as their addition in the resin layer allows changing the volume resistivity. Examples of such conductive agents include silicon oxide, alumina, carbon black, graphite, zinc oxide, titan black, iron oxide, titanium oxide, tin oxide, potassium titanate, calcium titanate, aluminium borate, magnesium oxide, barium sulphate, calcium carbonate, and the like.

A conductive agent may be used alone, or two or more conductive agents may be used in combination.

Among to above conductive agents, carbon black is preferable in view of production stability, cost, and low electrical resistance.

Kinds of carbon black are not limited specifically. The carbon blacks with an oil absorption for DBP (dibutyl phthalate) of 90 to 170 ml/100 g are preferable since they are excellent in production stability. The carbon blacks with a primary particle size of 50 nm or less are particularly preferable since they are excellent in the dispersibility.

The content of a conductive agent in the coating resin layer is preferably in the range of from 0.1 to 20 parts by weight of the conductive agent with respect to 100 parts by weight of the resin constituting the coating layer. If the content is less than 0.1 parts by weight, it is likely that the carrier does not have an appropriate electrical conductivity. If the content is greater than 20 parts by weight, the carrier has so high conductivity to leak its charge.

The surface coverage of the silicone resin layer on the core particle is preferably from 50 to 100%. If the surface coverage is less than 50%, it is likely that as only small portions of the resin layer (especially the outer layer if the resin layer is a two-layered structure) wear off, the total of the exposed core particle surface becomes large, thereby lowering the resistance of the carrier. As the result, the carrier is easy to adhere to the photoconductor, and therefore it is likely that the toner image is rough. The surface coverage can be varied appropriately by changing the coating amount of the resin. The definition of surface coverage of the resin layer for the core particle is indicated below.

The formation of the thermoset silicone resin layer can be made by any of the known methods. For example, the thermoset silicone resin layer is formed by the following method: a thermosetting silicon resin layer is formed on the core particle by a dip coating wherein the core particle is dipped in a solution of the materials for the resin layer in a solvent (for example, a organic solvent such as toluene, acetone or the like), and then the solvent is evaporated; and the thermosetting silicone resin layer is thermoset in an oven.

Two-Component Developer

The developer is described below.

The developer according to the present invention is a two-component developer comprising a toner and a carrier, wherein said carrier is the carrier according to the invention, as described above.

The mixing ratio is generally from 3 to 15 parts by weight of the toner with respect to 100 parts by weight of the carrier. Methods for mixing the toner and the carrier include mixing them in a mixer such as a Nauta mixer.

The toner is not limited specifically, and any of the known toners can be used, including, for example, a toner described below.

The toner comprises a colored resin particle (a toner particle) and optionally an external additive attached onto the surface of the colored resin particle. It is preferred that the toner comprises such an external additive since it prevents the toners from aggregating, and thus from decreasing in the transfer efficiency from the photoconductor drum to the recording material.

The volume average particle size of the colored resin particles is preferably in the range of from 4 to 7 μm. The use of the colored resin particles within such a size range can provide a high quality image with good dot reproducibility and with less toner fogging or scattering. The definition of volume average particle size of the colored resin particles is indicated below.

The BET specific surface area of the colored resin particle is preferably from 1.5 to 1.9 $m^2/g$. Since the BET specific surface area is 1.9 $m^2/g$ or less, many of the external additives cannot be not caught in the depressed portions of the surface of the colored resin particles, and therefore it is possible to easily attach the external additives to the colored particle in such a manner that they are distributed nearly evenly on the surface. Thus, the external additives can more efficiently exert their roller effect (for improving the toner fluidity) and spacer effect (for preventing the charge leakage), and toner fogging and scattering occur even less frequently in the toner image. Since the BET specific surface area is 1.5 $m^2/g$ or greater, the surface of the colored resin particle is not too smooth to be removed by the cleaning device, and therefore it is less likely that the surface of the photoconductor drum is insufficiently cleaned during the cleaning step. Thus, toner fogging occurs less frequently in the toner image.

BET specific surface area can be varied by any of the known methods, including, for example, a method wherein the colored resin particle is rounded in a rotating drum, and a method using a surfusion system wherein the colored resin particle is rounded by being melted instantaneously in a heated air flow. The definition of BET specific surface area is indicated below.

The colored resin particle can be prepared by any of the known methods such as mill pulverization and polymerization. For example, in the mill pulverization, the colored particles are prepared according to the following manner. A binder resin and a colorant, and optionally a charge control agent, a release agent and/or other additives are mixed in a mixer such as Henschel mixer, super mixer, mechanomill, or Q-type mixer. The resulting mixed materials are melt-kneaded at a temperature of 100 to 180° C. in a kneader such as a single screw kneader or a twin screw kneader. The kneaded materials are cooled, hardened, and then pulverized by a jet mill so as to obtain particles. The pulverized particles are optionally subjected to sizing or classifying.

As a binder resin, any of the commonly-used resin can be used, such as styrene-based resin, acrylic resins, polyester resins and others, although linear or non-linear polyester resins are preferable. The polyester resins can satisfy all the requirements of mechanical strength (sufficient for the toner not easily to break down into finer particulates), fixability (sufficient for the toner not easily to be released from the paper on which it is fixed) and hot offset resistance.

Polyester resins can be obtained by polymerizing a monomer composition comprising polyhydric alcohol and polybasic acid.

The dihydric alcohols that can be used for preparing polyester resins include for example diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, and 1,6-hexanediol, bisphenol A, hydrogenated bisphenol A, bisphenol A alkylene oxide adduct such as polyoxyethylene bisphenol A and polyoxypropylene bisphenol A.

The dibasic acids include for example maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, anhydrides or lower alkylester thereof, or alkenyl succinates or alkyl succinates such as n-dodecenyl succinate or n-dodecyl succinate.

As appropriate, a trihydric or higher polyhydric alcohol and/or a tribasic or higher polybasic acid may be added in the monomer composition. The trihydric or higher polyhydric alcohols include sorbitol, 1,2,3,6-hexane tetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and the others.

The tribasic or higher polybasic acids include for example 1, 2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid and anhydrides thereof, and the others.

As a colorant, it is possible to use any of the known pigments or dyes that are commonly used for toner.

Specifically, the colorants for black toner include for example carbon black, magnetite, and the like.

The colorants for yellow toner include, for example, acetoacetic acid arylamide type monoazo yellow pigments such as C.I. Pigment Yellow 1, C.I. Pigment Yellow 3, C.I. Pigment Yellow 74, C.I. Pigment Yellow 97, C.I. Pigment Yellow 98; acetoacetic acid arylamide type disazo yellow pigments such as C.I. Pigment Yellow 12, C.I. Pigment Yellow 13, C.I. Pigment Yellow 14, and C.I. Pigment Yellow 17; condensed monoazo yellow pigments such as C.I. Pigment Yellow 93 and C.I. Pigment Yellow 155; other type of yellow pigments such as C.I. Pigment Yellow 180, C.I. Pigment Yellow 150, and C.I. Pigment Yellow 185; yellow dyes such as C.I. Pigment Yellow 19, C.I. Pigment Yellow 77, and C.I. Pigment Yellow 79, C.I. disperse yellow 164, and the like.

The colorants for magenta toner include, for example, red or magenta pigments such as C.I. Pigment Red 48, C.I. Pigment Red 49:1, C.I. Pigment Red 53:1, C.I. Pigment Red 57, C.I. Pigment Red 57:1, C.I. Pigment Red 81, C.I. Pigment Red 122, C.I. Pigment Red 5, C.I. Pigment Red 146, C.I. Pigment Red 184, C.I. Pigment Red 238, C.I. Pigment Violet 19; red dyes such as C.I. Solvent Red 49, C.I. Solvent Red 52, C.I. Solvent Red 58, C.I. Solvent Red 8, and the like.

The colorants for cyan toner include, for example, blue pigments of copper phthalocyanine and derivatives thereof such as C.I. Pigment Blue 15:3, C.I. Pigment Blue 15:4; green pigments such as C.I. Pigment Green 7, C.I. Pigment Green 36 (Phthalocyanine Green), and the like.

The content of the colorant is preferably from 1 to 15 parts by weight, and more preferably 2 to 10 parts by weight, with respect to 100 parts by weight of the binder resin.

As a charge control agent used for toner, any of the known control agents can be used.

Specifically, the negative charge control agents include for example chromium-azo complex dyes, iron-azo complex dyes, cobalt-azo complex dyes, chromium/zinc/aluminium/boron complexes or salts of salicylic acid and derivatives thereof, chromium/zinc/aluminium/boron complexes or salts of naphthoic acid and derivatives thereof, chromium/zinc/aluminium/boron complexes or salts of benzilic acid and derivatives thereof, chromium/zinc/aluminium/boron complexes or salts of long chain alkyl carboxylates, long chain sulfonates, and the like. The expression "chromium/zinc/aluminium/boron complexes or salts" is intended herein to mean chromium complex or chromium salt compounds, zinc complex or zinc salt compounds, aluminium complex or aluminium salt compounds, or boron complex or boron salt compounds.

The positive charge control agents include for example nigrosine dyes and derivatives thereof, triphenyl methane derivatives, quaternary ammonium salts, quaternary phosphonium salts, quaternary pyridinium salts, guanidine salts, amidine salts, and the like.

It is preferable that the charge control agent used in the toner has the same polarity as the charge control agent used in the carrier. It is more preferable that the charge control agent used in the toner is of the same type as the charge control agent used in the carrier, since it is possible to prevent the occurrence of the toners charged oppositely to the other toners in the developer and to provide a good charge control effect.

The content of the charge control agent in the toner is preferably from 0.1 to 20 parts by weight and more preferably 0.5 to 10 parts by weight, with respect to 100 parts by weight of the binder resin.

The release agents that can be used for the toner include for example synthetic waxes such as polypropylene and polyethylene; petroleum waxes and the denatured waxes such as paraffin waxes and derivatives thereof, microcrystalline waxes and derivatives thereof, vegetable waxes such as carnauba wax, rice wax, candelila wax and derivatives thereof. In the case where the toner comprises a release agent, it is possible to improve the releasability of the toner from a fixing roller or belt, and to prevent hot offset and cool offset during the fixing step. The amount of the release agent added generally ranges from 1 to 5 parts by weights with regard to 100 parts by weight of the binder resin, although it is not specifically limited.

As an external additive, it is possible to use an inorganic particle, such as silica, titanium oxide, or alumina particle, having a number average particle size of 7 to 100 nm. The definition of number average particle size is indicated below. The external additive may be such an inorganic particle that is hydrophobized by being treated with a silane-coupling agent, titanium-coupling agent, silicone oil or the like. It is preferable to use the hydrophobic inorganic particle since it can reduce the decrease in the electric resistance or charge amount of the toner under high humidity environments. In particular, a silica particle into the surface of which trimethylsilyl groups are introduced by using hexamethylsilazane (hereinafter, also referred to as "HMDS") as a silane coupling agent has excellent hydrophobicity and insulation properties. Toner wherein such a silica particle is externally added has excellent chargeability even under high humidity environments.

Specific examples of external additives include AEROSIL 50, AEROSIL 90, AEROSIL 130, AEROSIL 200, AEROSIL 300 and AEROSIL 380 (number average particle size: about 30, 30, 16, 12, 7, and 7 nm respectively; Nippon Aerosil Co., Ltd., Japan) for silica; Aluminum Oxide C (number average particle size: about 13 nm; Degussa AG, Germany) for alumina; Titanium Oxide P-25 (number average particle size: about 21 nm; Degussa AG, Germany), and TTO-51 and TTO-55 (number average particle size: about 20 and 40 nm, respectively; Isihara Sangyo Kaisha Ltd., Japan) for titania; MOX 170 (number average particle size: about 16 nm; Nippon Aerosil Co., Ltd., Japan) for mixed silica and alumina, and the like. The Definition of number average particle size of the external additives is indicated below.

The external additive is externally added to the colored resin particle by mixing them in an air flow mixer such as a Henschel mixer.

The amount of the external additive added is preferably from 0.2 to 3% by weight. If the amount is less than 0.2% by weight, it is likely that the external additive cannot provide a sufficient fluidity to the toner. If the amount is greater than 3% by weight, fixability of the toner is decreased.

In the two-component developer according to the present invention, the increase in the toner charge is reduced in the early phase of use, and also the carrier adhesion to the electrophotoconductor and the decrease in the toner charge are reduced over a long period of time. Thus, the use of the developer according to the invention allows forming a stable image over a long period of time.

Image-Forming Apparatus

Here is described an electrophotographic image-forming apparatus according to the present invention.

It should be noted that the image-forming apparatus according to the invention can be provided in any own configuration and/or arrangements for an electrophotographic image-forming apparatus using a two-component developer, so far as it uses the two-component developer according to the invention as a developer.

The image-forming apparatus according to the invention comprises, for example, a photoconductor, on the surface of which an electrostatic latent image is formed; a charger unit, which charges the surface of said photoconductor; a light exposure unit, which forms said latent image on the surface of said photoconductor; a developing unit, which stores the two-component developer according to the invention and supplies said developer to said latent image on the surface of said photoconductor so as to develop it into a toner image; an image transfer unit, which transfers said toner image onto a recording medium; a cleaner unit, which cleans the surface of said photoconductor; and an image-forming unit, which fixes said toner image onto said recording material.

The image-forming apparatus can be for example copiers, printers, facsimile machines and composite machines thereof.

The image-forming apparatuses according to the present invention will be now described specifically with reference to the attached drawings.

Figure 3:
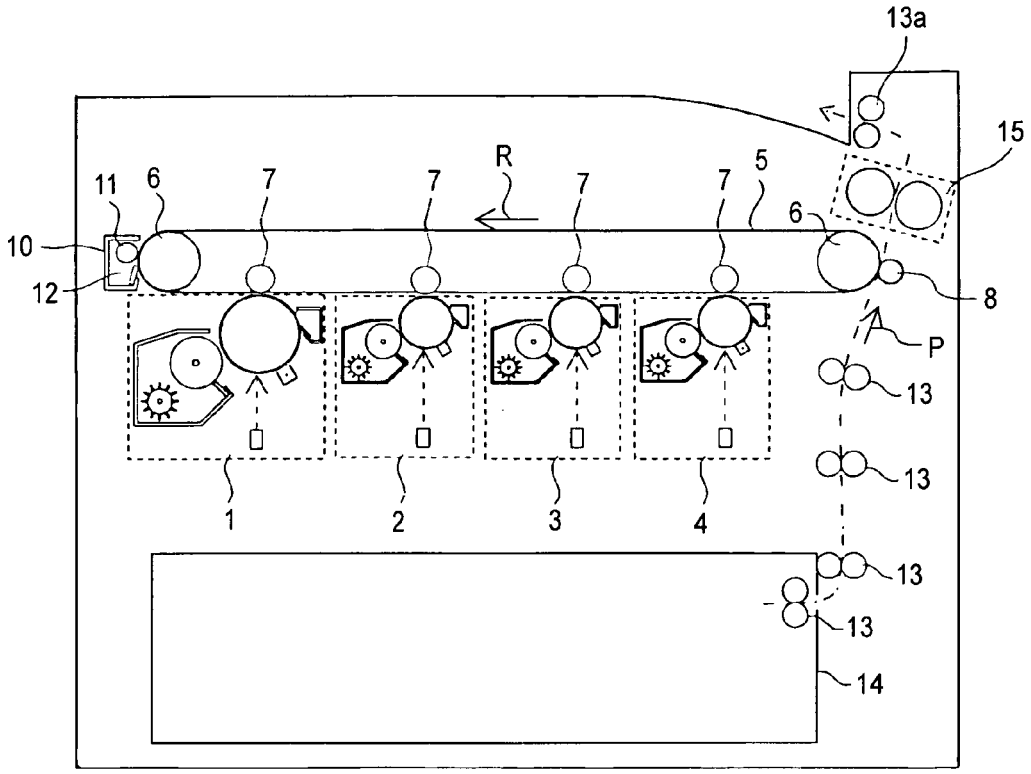
FIG. 3 is a schematic view illustrating an embodiment of a full color image-forming apparatus according to the invention.

FIG. 3 is a schematic illustration showing an embodiment of the image-forming apparatus. The illustrated image-forming apparatus is a color image-forming apparatus provided with four image-forming units 1-4 in tandem. Reference number 1 represents the first image-forming unit for forming a black toner image. Reference number 2 represents the second image-forming unit for forming a cyan toner image. Reference number 3 represents the third image-forming unit for forming a magenta toner image. Reference number 4 represents the fourth image-forming unit for forming a yellow toner image.

Over the four image-forming units 1-4, an intermediating transfer belt (endless belt) 5 is provided. The belt 5 is hanged on two supporting rolls 6, and rotates in the direction indicated by the arrow R. Hereinafter, the terms "upstream" and "downstream" is intended herein to mean the relative position with respect to the direction of rotation of the intermediating transfer belt 5. The material of the belt 5 can be a resin, such as polyimide or polyamide, which contains an appropriate amount of an electronically conductive agent.

The four image-forming units 1-4 are arranged from upstream to downstream in the order of the first (black) image-forming unit 1, the second (cyan) image-forming unit 2, the third (magenta) image-forming unit 3 and the fourth (yellow) image-forming unit 4.

Inside of the loop of the intermediating transfer belt 5, four primary transfer rollers 7 are provided with facing the respective photoconductor drums of the image-forming units 1-4. The four primary transfer rollers 7 transfer the respective monochromatic toner images formed by the image-forming units 1-4 onto the belt 5, where the monochromatic toner images are superimposed into a color image.

Downstream to the fourth (yellow) image-forming unit 4, a secondary transfer roller 8 is provided which transfers the color image formed on the belt 5 onto the paper (recording medium).

Downstream to the secondary transfer roller 8 and upstream to the first image-forming unit 1, a belt cleaning unit 10 is provided which cleans the surface of the intermediating transfer belt 5. The belt cleaning unit 10 has a belt cleaning brush 11, which is provided in contact with the belt 5, and a belt cleaning blade 12, which is provided downstream to the belt cleaning brush 11.

Below the image-forming units 1-4, a paper tray 14 is provided which stores papers. Each of the papers is transported by rollers 13, from the tray 14 to the secondary transfer point where the secondary transfer roller 8 faces the intermediating transfer belt 5. The arrow P indicates the direction of transportation of the papers.

Downstream to the secondary transfer roller 8 in the direction P of transportation of the papers, a fixing unit 15 is provided which fixes the transferred color image onto the paper. Further downstream to the fixing unit 15, a paper eject roller 13*a* is provided which ejects the paper, on which the color image is fixed, from the image-forming apparatus.

In the arrangement explained above, the respective monochromatic toner images formed by the image-forming units 1-4 are sequentially transferred and formed into a color image on the intermediating transfer belt 5. The color image is secondary-transferred from the belt 5 onto the paper transported by feed rollers 13 at the secondary transfer point. The color image is then fixed onto the paper by the fixing unit 15. The paper, on which the color image is fixed, is ejected from the image-forming apparatus by the paper eject rollers 13*a*. The toner remaining on the belt 5 is removed by the belt cleaning unit 10.

Figure 4:
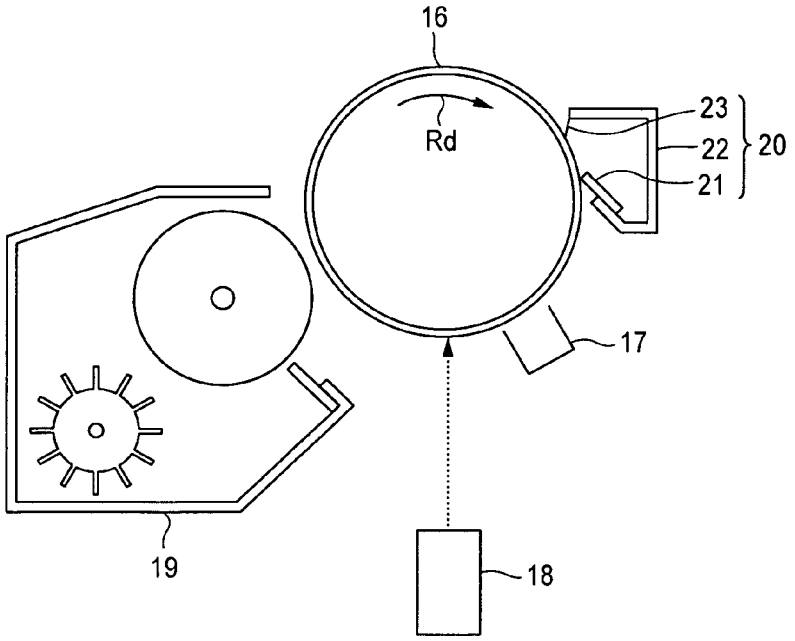
FIG. 4 is a schematic view illustrating an embodiment of an image-forming apparatus (image-forming unit) according to the invention.

FIG. 4 is an enlarged illustration of the first image-forming unit 1 shown in FIG. 3. The structures of the other image-forming units 2-4 are substantially the same as the first image-forming unit 1. Therefore, the detailed description of the second, third and fourth image-forming units are omitted.

Along the circumferential surface of the photoconductor drum 16, a charger unit 17, which charges said drum 16; a light exposure unit 18, which writes an electrostatic latent image on said drum 16; a developing unit 19, which visualizes said latent image on said drum 16; and a cleaner unit 20, which remove the residues (including toner) remaining on said drum 16 after primary transferring, are provided.

The charger unit 17 comprises, for example, a scorotron charger, which charges the surface of the photoconductor drum 16 at a given potential by corona charging. The charger unit 17 may comprise a corotoron charger or a contact charger using a charger roller or brush.

The light exposure unit 18 comprises, for example, a laser exposure unit, which emits light according to the image information, as scanning the charged surface of the photoconductor drum 16 so that an electrostatic latent image is formed corresponding to the image information by erasing the charge in the light-exposed area of the surface. The light exposure unit 18 may comprise an LED array device or the like.

The developing unit 19 stores the two-component developer according to the present invention in the developer tank 27, and develops the electrostatic latent image on the surface of the photoconductor drum 16 with the toner contained in the developer.

The cleaner unit 20 comprises a cleaner blade 21, a cleaner housing 22 and a sealer 23.

The cleaner blade 21 is pressed to the surface of the photoconductor drum 16 against the direction of rotation Rd of the drum 16 and scrapes the residues from the surface of the drum 16. The cleaner blade 21 is attached to 20 the cleaner housing 22 in which the scraped residues are collected. The sealer 23 is provided upstream to the cleaner blade 21 in the direction of rotation Rd. One edge of the sealer 23 is fixed to the cleaner housing 22 and the other edge is pressed against the surface of the drum 16 so that the sealer 23, together with the cleaner blade 21, seals the housing 22.

Figure 5:
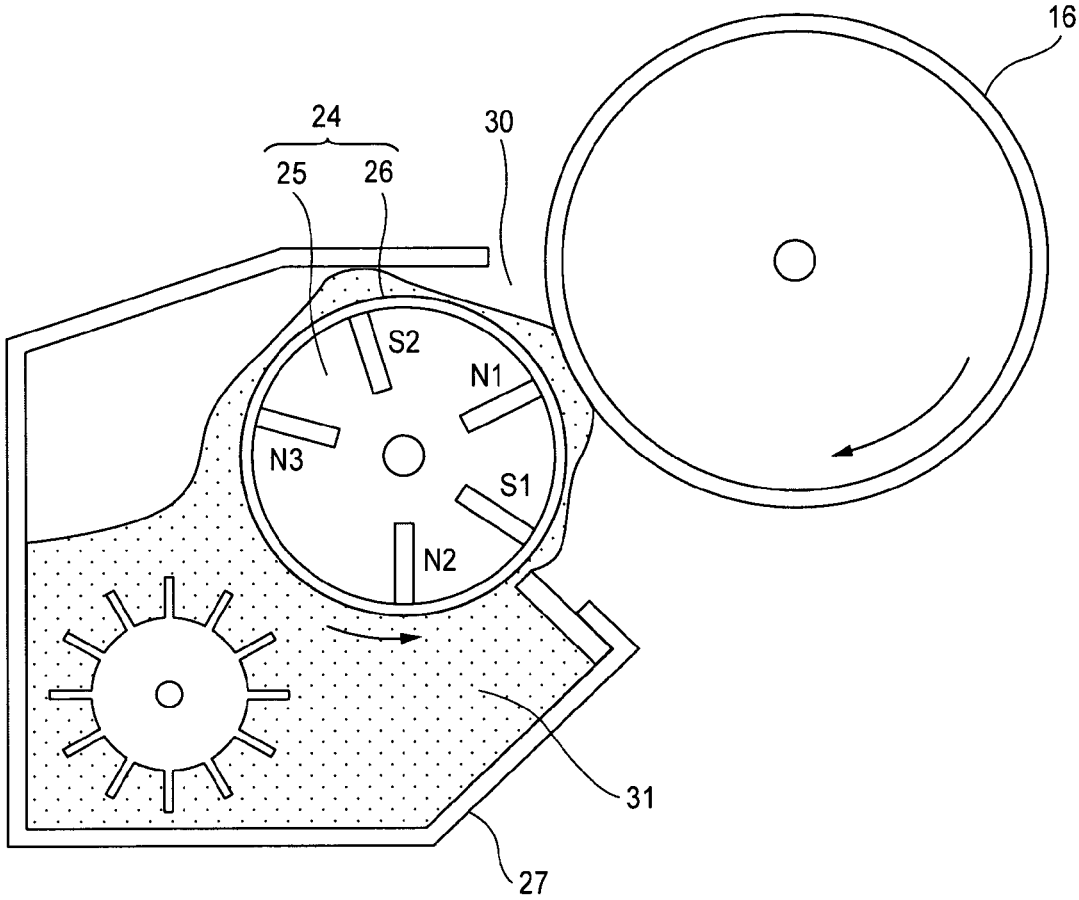
FIG. 5 is an extended schematic view illustrating an embodiment of a developing device used in a image-forming apparatus according to the invention.

FIG. 5 illustrates, in more detail, the structure of the developing unit 19 shown in FIG. 4.

The developing unit 19 comprises a developer tank 27 which stores the two-component developer according to the invention. The tank 27 has an opening 30 facing the circumferential surface of the photoconductor drum 16.

In the tank 27, a developing roller 24 is provided with facing the drum 16 through the opining 30. The developing roller 24 carries the two-component developer on its circumferential surface and supplies it onto the drum 16 so as to develop the latent image thereon. The circumferential surfaces of the developing roller 24 and the drum 16 are spaced at a given distance.

The developing roller 24 comprises a multipole magnetic member 25 and a non-magnetic sleeve 26 mounted rotatably thereon. The magnetic member 25 comprises six rectangular bar magnets in a radial arrangement so that the N poles (N1, N2 and N3) of three magnets and the S poles (S1 and S2) of the remaining magnets are spaced on the circumferential surface of the magnetic member 25.

The multipole magnetic member 25 is nonrotatably supported by two opposite side walls of the tank 27. The N1 pole (peak flux density: 110 mT) is situated on the line connecting the center of the magnetic member 25 and the center of rotation of the photoconductor drum 16. The S1 pole (−78 mT) is situated upstream to the N1 pole in the direction of rotation the sleeve 26, with the center angle between the S1 and N1 poles being 59° for example. The N2 pole (56 mT) is situated more upstream to the N1 pole, with the center angle between the N2 and N1 poles being 117° for example. The N3 pole (42 mT) is situated further more upstream to the N1 pole, with the center angle between the N3 and N1 poles being 224° for example. The S2 pole (80 mT) is situated still further more upstream to the N1 pole, with the center angle between the S1 and N1 poles being 282° for example.

A metering member 28 is provided upstream from the closest point of the sleeve 26 to the circumferential surface of the photoconductor drum 16, in the direction of rotation of the sleeve. The metering member 28 regulates the thickness of the layer of the developer carried by the sleeve 26, i.e., the amount of the developer to be transported to the latent image. The metering member 28 is situated at a given distance from the surface of the sleeve 26.

In the tank 27, a mixing member 29 is provided with facing the developing roller 24. The mixing member 29 can rotate so as to mix the developer 31 in the tank 27 and supply the developer 31 to the developing roller 24.

In the image-forming apparatus according to the present invention, the charge amount of the toner is stable over a long period of time, and thus the image quality is stable over a long period of time.

DEFINITIONS

The terms "volume average particle size", "saturation magnetization", "volume resistivity", "surface coverage", "BET specific surface area" and "number average particle size" used herein are defined below:

Volume Average Particle Size of Carriers and Core Particles

The volume average particle size of carriers or core particles, as used herein, is intended to mean a value determined by using the Sympatec HELOS laser diffraction spectrometer (Sympatec GmbH, Germany) with the Sympatec RODOS dry disperser (Sympatec GmbH, Germany) under a dispersing pressure of 3.0 bar.

Volume Average Particle Size of Colored Resin Particles

The volume average particle size of colored resin particles, as used herein, is intended to mean a value determined by using the Coulter Multisizer II particle size analyzer (Beckman Coulter Inc., U.S.A.) with an aperture diameter of 100 μm.

More specifically, the measuring apparatus is Coulter Counter TA-II or Coulter Multisizer II (Beckman Coulter Inc., U.S.A.). As an electrolyte solution, 1% sodium chloride solution is used, such as ISOTON R-II (Coulter Scientific Japan, Inc., Japan).

For measurement, 2 to 20 mg of sample is added in 100 to 150 ml of the electrolyte solution, to which 0.1 to 5 ml of a surfactant (preferably alkylbenzene sulfonate) has previously been added as a dispersing agent. The resulting suspension is subjected to dispersion treatment with an ultrasonic disperser for 1 to 3 minutes. The volume and the number of the particles in the suspension are measured on the said particle size analyzer with an aperture of 100 μm to create volume and number distributions of the particle size. The volume distribution is used to determine the volume average particle size.

Saturation Magnetization

The saturation magnetization, as used herein, is intended to mean a value determined by using the Vibrating Sample Magnometer VSMP-1 (Toei Industry Co., Ltd., Japan).

Volume Resistivity

The volume resistivity of core particles or carriers, as used herein, is intended to mean a value determined according to the following manner. The core particles or carriers of 0.2 g are filled in between two copper electrode plates (30 mm wide×10 mm high) spaced 6.5 mm under environmental conditions of a temperature of 20° C. and a humidity of 65%. Then, two magnets (100 mT each) are placed outside the respective electrode plates with the N pole of one facing the S pole of the other, so that the magnetic force causes the core particles or carriers to bridge the electrode. Fifteen seconds after applying a voltage of 500 V between the electrodes, the electric current therebetween is measured. The electric current is used to determine the volume resistivity.

Surface Coverage

The surface coverage of the coating resin layer on the core particle is intended to mean a value determined according to the following manner. The surface of the carrier is observed with a scanning electron microscope (SEM) using an electron beam at an accelerating voltage of 2.0 eV, without any conducting material such as gold being vapor-deposited on the surface. The coating resin layer looks white due to charge-up. The ratio of the white area to the total surface area is calculated on a hundred of carriers. The average of the ratio is considered to the surface coverage.

BET Specific Surface Area

The BET specific surface area, as used herein, is intended to mean a value determined on the surface area analyzer Gemini 2360 (Shimadzu Corporation, Japan)

Number Average Particle Size

The number average particle size, as used herein, is intended to mean the number average diameter of 100 particles in a scanning electron microscopic (SEM) image.

EXAMPLES

The present invention will now be described in detail with reference to the following examples, which are intended to illustrate but not to limit the scope of the present invention.

Synthesis of Charge Control Agents

Compounds 1, 2 and 3 (organic silicon complex compounds represented by the general formula (1)) and Compounds 4 and 5 (calixarene compounds represented by the general formula (2)) were synthesized for use as charge control agents for the carriers in the following Examples and Comparative Examples.

Synthesis of Compound 1

A solution of 2.28 g (10 mmol) of benzilic acid, 0.99 g (5 mmol) of phenyltrimethoxysilane, 1 g (14 mmol) of n-butylamine in 10 ml of methanol was refluxed for 2 hours. After the solvent was evaporated, the product was recrystallized with acetone-carbon tetrachloride and then filtered. The residue was dried to obtain 2 g of a white powder (Compound 1). The melting point of Compound 1 was 145° C.

Synthesis of Compound 2

According to the procedure for Compound 1 except the mandelic acid (1.52 g, 10 mmol) was used instead of benzilic acid, 0.5 g of a white powder (Compound 2) was obtained. The melting point of Compound 2 was 107° C.

Synthesis of Compound 3

According to the procedure for Compound 1 except the hexamethylenediamine (0.6 g, 5.2 mmol) was used instead of n-butylamine, 2 g of a white powder (Compound 3) was obtained. The melting point of Compound 3 was 147° C.

Synthesis of Compound 4 p-tert-butylcalix(8)arene (12.96 g, 0.01 mol) and potassium carbonate (4.14 g, 0.03 mol) were refluxed in 100 ml of methyl isobutyl ketone (MIBK) for 8 hours. After adding benzyl bromide (5.1 g, 0.03 mol), the mixture was refluxed for 30 hours, left to cool and filtered with suction. The filtrate was vacuum dried, and then the dried product was subjected to recrystallization from chloroform/n-hexane to obtain 7 g of a white powder (Compound 4). The melting point of Compound 4 was 205° C.

Synthesis of Compound 5 p-tert-butylphenol (0.5 mol), tert-octylphenol (0.5 mol), paraformaldehyde (1.2 mol) and potassium hydroxide (1.0 g) were refluxed in 500 ml of xylene for 7 hours while removing water so as to obtain a calix(8)arene mixture (15.2 g, 0.01 mol). The calix(8)arene mixture together with potassium carbonate (4.14 g, 0.03 mol) was refluxed in 100 ml of methyl isobutyl ketone (MIBK) for 8 hours. After adding benzyl bromide (5.1 g, 0.03 mol), the resulting mixture was refluxed for 10 hours, left to cool and filtered with suction. The filtrate was vacuum-dried, and the dried product was subjected to recrystallization from methanol to obtain 8 g of a pale yellow-white powder (Compound 5). The melting point of Compound 5 was 169° C.

Carrier

The carriers used in the following Examples and Comparative Examples were prepared according to the following manner.

Iron oxide (50 mol %), manganese oxide (35 mol %), magnesium oxide (14.5 mol %) and strontium oxide (0.5 mol %) (all available from Kanto Denka Kogyo Co., Ltd., Japan) were pulverized in a ball mill for 4 hours. The resulting slurry was spray-dried to give spherical particles, which was calcinated at a temperature of 930° C. for 2 hours in a rotary kiln. The calcinated particles were milled in a wet mill (using steel balls as milling medium) so as to give fine particles having an average diameter of 2 μm or less. The resulting slurry, together with 2% by weight of PVA, was granulated with a spray-dryer. The granulates were baked in a electric furnace at a temperature of 1100° C. and an oxygen concentration of 0% by volume for 4 hours, and then crushed and classified so as to obtain ferrite core particles having a volume average particle size of 44 μm and a volume resistivity of $1\times10^9$ Ω·cm.

The primary coating liquid for forming the thermoset silicone resin layer not containing a charge control agent (the inner region or layer) was prepared by solubilizing 100 parts by weigh of dimethyl silicone (Toshiba Silicone Co., Ltd.) and 5 parts by weight of octylic acid as a curing catalyst in toluene.

The core particles prepared above were coated with the primary coating liquid by dip coating in a versatile mixer (model NDMV; Dalton Co., Ltd., Japan), and then the toluene was completely evaporated so as to prepare the primary carriers coated with the primary silicone layer having a surface coverage of 90%.

The secondary coating liquid for forming the thermoset silicone resin layer containing a charge control agent (the outer region or layer) was prepared by solubilizing 100 parts by weigh of dimethyl silicon (Toshiba Silicone Co., Ltd.), Compound 1 (Melting point=145° C.) as a charge control agent, and 5 parts by weight of octylic acid as a curing catalyst in a mixed solvent of toluene and methanol (10:1). The primary carriers were coated with the secondary coating liquid by dip coating in a versatile mixer (model NDMV; Dalton Co., Ltd., Japan). After the solvent was completely evaporated, the particles were heat-treated (i.e., the silicone resin layers were heat-cured) at a temperature of 100° C. for 60 minutes in an oven so as to obtain carrier C1.

Carrier C1 had a volume average particle size of 45 μm, a surface coverage of the secondary (outer) silicone layer of 100%, a volume resistivity of $2\times10^{12}$ Ω·cm, and a magnetization saturation of 65 emu/g.

Carriers C2-C17 were prepared as described above for C1 except that the kind of the respective charge control agents added and/or the temperature and time for heat-curing were different from those used for C1, and that in the case of C12, no charge control agent was added, as shown in Table 1.

TABLE 1

| | Coated Carriers | | | | | | |
|---|---|---|---|---|---|---|---|
| | Charge Control Agent (CCA) | Melting Point (° C.) | Amount of CCA added | Curing Temperature (° C.) | Time for heat curing (min) | Volume Average Particle Size (μm) | Saturation Magnetization (emu/g) |
| C1 | Compound 1 | 145 | 5 | 100 | 60 | 45 | 65 |
| C2 | Compound 2 | 107 | 5 | 80 | 60 | 45 | 65 |
| C3 | Compound 3 | 147 | 5 | 100 | 60 | 45 | 65 |
| C4 | Compound 4 | 205 | 5 | 150 | 60 | 45 | 65 |
| C5 | Compound 5 | 169 | 5 | 120 | 60 | 45 | 65 |
| C6 | Compound 1 | 145 | 5 | 135 | 30 | 45 | 65 |
| C7 | Compound 1 | 145 | 5 | 70 | 120 | 45 | 65 |
| C8 | Compound 3 | 147 | 5 | 140 | 30 | 45 | 65 |
| C9 | Compound 3 | 147 | 5 | 70 | 120 | 45 | 65 |
| C10 | Compound 4 | 205 | 5 | 195 | 30 | 45 | 65 |
| C11 | Compound 4 | 205 | 5 | 70 | 120 | 45 | 65 |
| C12 | — | | 0 | 100 | 60 | 45 | 65 |
| C13 | Compound 1 | 145 | 5 | 150 | 60 | 45 | 65 |
| C14 | Compound 2 | 107 | 5 | 115 | 60 | 45 | 65 |
| C15 | Compound 3 | 147 | 5 | 155 | 60 | 45 | 65 |
| C16 | Compound 4 | 205 | 5 | 210 | 60 | 45 | 65 |
| C17 | Compound 5 | 169 | 5 | 175 | 60 | 45 | 65 |

Toner

Toners were prepared according to the method described below.

The toner materials used were:

Binder resin (a polyester resin obtained by polycondensing bisphenol A propylene oxide with terephthalic acid or trimellitic acid anhydride as monomers, glass transition temperature (Tg)=60° C., softening temperature=115° C.; Fujikura Kasei Co., Ltd., Japan): 100 parts by weight Colorant (C.I. Pigment Blue 15:3): 5 parts by weight Charge control agent (LR-147, a boron compound; Japan Carlit Co., Ltd., Japan): 2 parts by weight Release agent (Microcrystalline Wax HNP-9; Nippon Seiro Co., Ltd., Japan): 3 parts by weight After the toner materials were mixed in a Henschel mixer for 10 minutes, they were melt-kneaded at 150° C. in a kneader-pelletizer (KNEADEX MOS140-800; Mitsui Mining Co., Ltd., Japan). The kneaded materials were cooled, solidified, cut into pieces by a cutting mill, and then pulverized by a jet pulverizer (IDS-2; Nippon Pneumatic Mfg. Co., Ltd., Japan). The pulverized particles were classified with a air classifier (MP-250. Nippon Pneumatic Mfg. Co., Ltd., Japan), so as to obtain colored resin particles having a volume average particle size of 6.5±0.1 μm and a BET specific surface area of 1.8±0.1 $m^2/g$.

A hundred parts by weight of the colored resin particles thus obtained were mixed with 1 part by weight of hexamethyldisilazane-treated silica particles with a number average particle size of 12 nm (AEROSIL R8200; Evonik Degussa Japan Co., Ltd., Japan) in an air mixer (Henschel mixer; Mitsui Mining Co., Ltd., Japan) at a blade speed of 15 m/sec for 2 minutes, so as to obtain negative chargeable toner T1.

Two-Component Developer

The two-component developers of Examples and Comparative Examples were prepared by mixing carriers C1 to C6 respectively with toner T1. Mixture of the two components were conducted by mixing 6 parts by weight of the toner and 94 parts by weight of the carrier in a Nauta mixer (VL-0; Hosokawa Micron Corporation, Japan) for 20 minutes.

Image Evaluation

For the two-component developers prepared, a continuous print test was conducted on an image-forming apparatus (aging test apparatus) shown in FIG. 3. In the continuous print tests, only the image-forming unit 1 of the four units of the image-forming apparatus was used. The developing conditions used in the image-forming apparatus were: photocon ductor's peripheral speed of 400 mm/sec; developing roller's peripheral speed of 560 mm/sec; the gap distance between the photoconductor and the developing roller of 0.42 mm; the gap distance between the developing roller and the metering blade of 0.5 mm. The surface potential of the photoconductor and the developing bias were adjusted in such a manner that the amount of toner attached was 0.5 mg/cm$^2$ in the solid image (100% density) and the least in the blank area on a printed paper. For the test, A4-sized electrophotographic papers (Multi-Receiver; Sharp Document Systems Corporation, Japan) were used.

In the print test, a text image was printed at 6% coverage on 2,000 sheets. At the start and after printing 2,000 sheets, the charge of the toner, the image density and the fogging density were measured and evaluated as explained below.

The charge of the toner was measured on a portable charge measurement device (TREK Model 210HS-2A; TREK Japan K.K., Japan)

The image density was measured on a reflection densitometer (Macbeth RD918; Gretag-Macbeth GmbH, Germany) in the printing area of the paper where a 3-cm square solid image (100% density) was printed. The evaluation of the image density was based on the following criteria: "Good" when the image density is 1.3 or more (when the paper fibers in the printed area are completely coated with the toner), "Less Good" when the density is 1.2 or more and less than 1.3, and "No Good" when the density is less than 1.2 (when the paper fibers in the printed area are insufficiently coated with the toners).

For the fogging density, the image density in a blank area (0% density) was calculated according to the following manner.

The degree of whiteness was measured in a paper before printing and in an unprinting area of the paper after printing on a whiteness meter (Z-Σ90 COLOR MEASURING SYSTEM; Nippon Denshoku Industries Co., Ltd., Japan). The difference in the degree of whiteness was considered as the fogging density.

The evaluation of the fogging density was based on the following criteria: "Good" when the fogging density is less than 0.6 (when no toner fog can be found macroscopically), "Less Good" when the density is 0.6 or more and less than 1.0, and "No Good" when the density is 1.0 or more (when toner fog can be found macroscopically).

Results

The results of the continuous printing test are given in Table 2.

TABLE 2

| | | At the start | | | After printing 2000 sheets | | |
|---|---|---|---|---|---|---|---|
| | Carrier | Charge (μc/g) | Image Density | Fogging | Charge (μc/g) | Image Density | Fogging |
| Example 1 | C1 | 22.5 | Good | Good | 22.3 | Good | Good |
| Example 2 | C2 | 23.5 | Good | Good | 23.1 | Good | Good |
| Example 3 | C3 | 22.8 | Good | Good | 22.8 | Good | Good |
| Example 4 | C4 | 23.7 | Good | Good | 23.6 | Good | Good |
| Example 5 | C5 | 24.1 | Good | Good | 23.9 | Good | Good |
| Example 6 | C6 | 22.6 | Good | Good | 23.2 | Good | Good |
| Example 7 | C7 | 23.0 | Good | Good | 22.7 | Good | Good |
| Example 8 | C8 | 22.9 | Good | Good | 23.0 | Good | Good |
| Example 9 | C9 | 23.2 | Good | Good | 24.5 | Good | Good |
| Example 10 | C10 | 23.9 | Good | Good | 23.1 | Good | Good |
| Example 11 | C11 | 24.4 | Good | Good | 22.9 | Good | Good |
| Comparative Example 1 | C12 | 24.3 | Good | Good | 27.4 | No Good | Good |
| Comparative Example 2 | C13 | 21.5 | Good | Good | 27.3 | No Good | Good |
| Comparative Example 3 | C14 | 22.0 | Good | Good | 26.8 | No Good | Good |
| Comparative Example 4 | C15 | 22.4 | Good | Good | 27.1 | No Good | Good |
| Comparative Example 5 | C16 | 21.8 | Good | Good | 26.5 | No Good | Good |
| Comparative Example 6 | C17 | 21.5 | Good | Good | 26.9 | No Good | Good |

When using the developers of Examples 1-11, the charge of the toner was stable, the image density was high, and no toner fogging occurred even after printing 2,000 sheets.

In contrast, when using the developers of Comparative Examples 16, the charge of the toner was increased after printing 2,000 sheets. In parallel, the image density was decreased in the printed image after printing 2,000 sheets.

What is claimed is:

1. A carrier for a two-component electrophotographic developer, comprising a core particle and a thermoset silicone resin layer coated thereon, wherein said layer comprises a charge control agent and is formed by heat-treatment at a temperature below the melting point of said charge control agent.

2. The carrier according to claim 1, wherein said charge control agent is an organic silicon complex compound represented by the general formula (1):

(1)

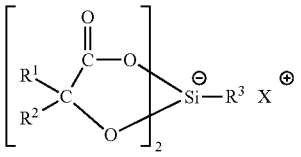

wherein $R^1$, $R^2$ and $R^3$ each independently represent hydrogen atom, or a substituted or unsubstituted, alkyl, cycloalkyl, aryl or aralkyl group; and $X^+$ represents an organic or inorganic cation, or a calixarene compound represented by the general formula (2):

(2)

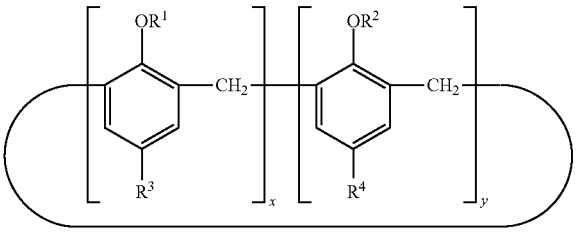

wherein x+y=n; x and y are each an integer equal to or greater than 1; n is an integer from 4 to 8; the x and y repeating units can occur in any order; $R^1$, $R^2$, $R^3$ and $R^4$ each independently represent hydrogen atom, an optionally branched alkyl group having 1 to 12 carbon atoms, an optionally substituted aralkyl group having 7 to 12 carbon atoms, or an optionally substituted phenyl group.

3. The carrier according to claim 1, wherein said thermoset silicone resin layer is formed by coating said core particle with a thermosetting silicone resin not containing said charge control agent, and then with a thermosetting silicone resin containing said charge control agent, and subsequently by said heat treatment at a temperature below the melting point of said charge control agent.

4. The carrier according to claim 3, wherein said thermosetting silicone resin containing said charge control agent further comprises a conductive agent.

5. The carrier according to claim 1, wherein said thermoset silicone resin layer is a dimethyl silicone resin layer.

6. The carrier according to claim 1, wherein said core particle comprises ferrite.

7. A two-component electrophotographic developer comprising the carrier according to claim 1 and a toner.

8. An electrophotographic image-forming apparatus which comprising the two-component developer according to claim 7 as a developer.

* * * * *